US009461371B2

(12) United States Patent
Kuonanoja

(10) Patent No.: US 9,461,371 B2
(45) Date of Patent: Oct. 4, 2016

(54) MIMO ANTENNA AND METHODS

(75) Inventor: Reetta Kuonanoja, Oulu (FI)

(73) Assignee: Pulse Finland OY (FI)

( * ) Notice: Subject to any disclaimer, the term of this patent is extended or adjusted under 35 U.S.C. 154(b) by 953 days.

(21) Appl. No.: 13/511,643

(22) PCT Filed: Nov. 16, 2010

(86) PCT No.: PCT/FI2010/050926
§ 371 (c)(1),
(2), (4) Date: Sep. 25, 2012

(87) PCT Pub. No.: WO2011/064444
PCT Pub. Date: Jun. 3, 2011

(65) Prior Publication Data

US 2013/0044036 A1 Feb. 21, 2013

(30) Foreign Application Priority Data

Nov. 27, 2009 (FI) ..... 20096251

(51) Int. Cl.

| | |
|---|---|
| ***H01Q 21/00*** | (2006.01) |
| ***H01Q 21/28*** | (2006.01) |
| ***H01Q 1/24*** | (2006.01) |
| ***H01Q 1/38*** | (2006.01) |
| ***H01Q 9/40*** | (2006.01) |

(Continued)

(52) U.S. Cl.
CPC ..... *H01Q 21/28* (2013.01); *H01Q 1/243* (2013.01); *H01Q 1/38* (2013.01); *H01Q 9/40* (2013.01); *H01Q 9/42* (2013.01); *H01Q 21/29* (2013.01)

(58) Field of Classification Search
CPC ..... H01Q 21/00; H01Q 1/38; H01Q 1/24
USPC ..... 343/810, 702, 700 MS, 846
See application file for complete search history.

(56) References Cited

U.S. PATENT DOCUMENTS

| | | | |
|---|---|---|---|
| 2,745,102 | A | 5/1956 | Norgorden |
| 3,938,161 | A | 2/1976 | Sanford |
| 4,004,228 | A | 1/1977 | Mullett |

(Continued)

FOREIGN PATENT DOCUMENTS

| | | | |
|---|---|---|---|
| CN | 1316797 | | 10/2007 |
| CN | 201319403 | Y | 9/2009 |

(Continued)

OTHER PUBLICATIONS

Vergerio, S et al. "A Two-PIFA Antenna Systems for Mobile Phone at 2 GHz With MIMO Applications", National Board of Patents and Registrations downloaded on Jun. 17, 2010.

(Continued)

*Primary Examiner* — Huedung Mancuso
(74) *Attorney, Agent, or Firm* — Gazdzinski & Associates, PC

(57) ABSTRACT

An antenna structure that provides spatial multiplexing capabilities. In one embodiment, the antenna comprises two antenna components with a substrate and radiator, the components being located on opposite sides of the circuit board of a radio device. Each antenna component operates in combination with the ground plane of the radio device to form a partial antenna, the operating band of which is below the frequency of 1 GHz. The ground plane and the feed points of the partial antennas are arranged so that the 'dipole axes' of the partial antennas have clearly different directions at the frequencies of said operating band.

17 Claims, 4 Drawing Sheets

Figure 1:
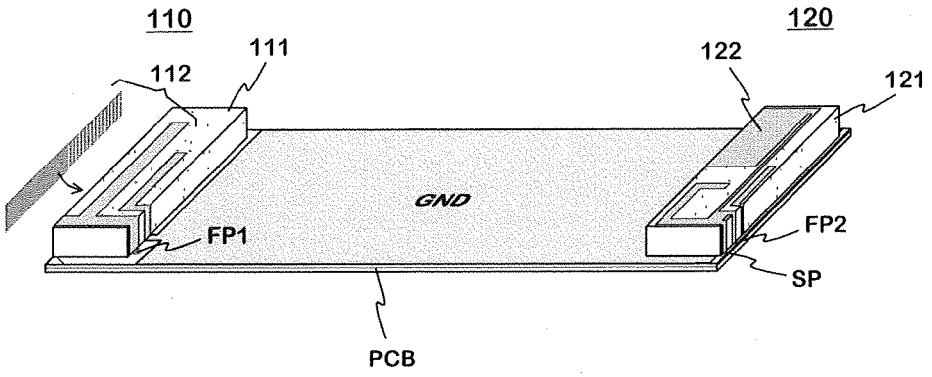
Fig. 1 PRIOR ART

(51) Int. Cl.
*H01Q 9/42* (2006.01)
*H01Q 21/29* (2006.01)

(56) References Cited

U.S. PATENT DOCUMENTS 4,028,652 A 6/1977 Wakino et al.
4,031,468 A 6/1977 Ziebell et al.
4,054,874 A 10/1977 Oltman
4,069,483 A 1/1978 Kaloi
4,123,756 A 10/1978 Nagata et al.
4,123,758 A 10/1978 Shibano et al.
4,131,893 A 12/1978 Munson et al.
4,201,960 A 5/1980 Skutta et al.
4,255,729 A 3/1981 Fukasawa et al.
4,313,121 A 1/1982 Campbell et al.
4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,652,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,835,538 A 5/1989 McKenna et al.
4,835,541 A 5/1989 Johnson et al.
4,862,181 A 8/1989 PonceDeLeon et al.
4,879,533 A 11/1989 De Muro et al.
4,896,124 A 1/1990 Schwent
4,907,006 A 3/1990 Nishikawa et al.
4,954,796 A 9/1990 Green et al.
4,965,537 A 10/1990 Kommrusch
4,977,383 A 12/1990 Niiranen
4,980,694 A 12/1990 Hines
5,016,020 A 5/1991 Simpson
5,017,932 A 5/1991 Ushiyama et al.
5,043,738 A 8/1991 Shapiro et al.
5,047,739 A 9/1991 Kuokkanene
5,053,786 A 10/1991 Silverman et al.
5,057,847 A 10/1991 Vaeisaenen
5,061,939 A 10/1991 Nakase
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,280 A 8/1995 Baudart
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,510,802 A 4/1996 Tsuru et al.
5,517,683 A 5/1996 Collett et al.
5,521,561 A 5/1996 Yrjola
5,526,003 A 6/1996 Ogawa et al.
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,566,441 A 10/1996 Marsh et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prodhomme et al.
5,668,561 A 9/1997 Perrotta et al.
5,675,301 A 10/1997 Nappa
5,689,221 A 11/1997 Niiranen
5,694,135 A 12/1997 Dikun et al.
5,696,517 A 12/1997 Kawahata et al.
5,703,600 A 12/1997 Burrell et al.
5,709,832 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,760,746 A 6/1998 Kawahata
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,797,084 A 8/1998 Tsuru et al.
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom

(56) References Cited

U.S. PATENT DOCUMENTS 5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Tadahiko et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,052,096 A 4/2000 Tsuru et al.
6,072,434 A 6/2000 Papatheodorou
6,078,231 A 6/2000 Pelkonen
6,091,363 A 7/2000 Komatsu et al.
6,091,365 A 7/2000 Anders et al.
6,097,345 A 8/2000 Walton
6,100,849 A 8/2000 Tsubaki et al.
6,112,108 A 8/2000 Crowley et al.
6,121,931 A 9/2000 Levi et al.
6,133,879 A 10/2000 Grangeat et al.
6,134,421 A 10/2000 Lee et al.
6,140,966 A 10/2000 Pankinaho
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,218,989 B1 4/2001 Schneider et al.
6,246,368 B1 6/2001 Deming et al.
6,252,552 B1 6/2001 Tarvas et al.
6,252,554 B1 6/2001 Isohatala
6,255,994 B1 7/2001 Saito
6,268,831 B1 7/2001 Sanford
6,281,848 B1 8/2001 Nagumo et al.
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,343,208 B1 1/2002 Ying
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham et al.
6,421,014 B1 7/2002 Sanad
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,767 B2 11/2002 Aoyama et al.
6,476,769 B1 11/2002 Lehtola
6,480,155 B1 11/2002 Eggleston
6,483,462 B2 11/2002 Weinberger
6,498,586 B2 12/2002 Pankinaho
6,501,425 B1 12/2002 Nagumo
6,515,625 B1 2/2003 Johnson
6,518,925 B1 2/2003 Annamaa
6,529,168 B2 3/2003 Mikkola
6,529,749 B1 3/2003 Hayes et al.
6,535,170 B2 3/2003 Sawamura et al.
6,538,604 B1 3/2003 Isohatala
6,538,607 B2 3/2003 Barna
6,542,050 B1 4/2003 Arai et al.
6,549,167 B1 4/2003 Yoon
6,552,686 B2 4/2003 Ollikainen et al.
6,556,812 B1 4/2003 Pennanen et al.
6,566,944 B1 5/2003 Pehlke
6,580,396 B2 6/2003 Lin
6,580,397 B2 6/2003 Lindell
6,600,449 B2 7/2003 Onaka
6,603,430 B1 8/2003 Hill et al.
6,606,016 B2 8/2003 Takamine et al.
6,611,235 B2 8/2003 Barna et al.
6,614,400 B2 9/2003 Egorov
6,614,401 B2 9/2003 Onaka et al.
6,614,405 B1 9/2003 Mikkonen
6,634,564 B2 10/2003 Kuramochi
6,636,181 B2 10/2003 Asano
6,639,564 B2 10/2003 Johnson
6,646,606 B2 11/2003 Mikkola
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,680,705 B2 1/2004 Tan et al.
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas
6,911,945 B2 6/2005 Korva

(56) References Cited

U.S. PATENT DOCUMENTS 6,922,171 B2 7/2005 Annamaa
6,925,689 B2 8/2005 Folkmar
6,927,729 B2 8/2005 Legay
6,937,196 B2 8/2005 Korva
6,950,065 B2 9/2005 Ying et al.
6,950,066 B2 9/2005 Hendler et al.
6,950,068 B2 9/2005 Bordi
6,950,072 B2 9/2005 Miyata et al.
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,980,158 B2 12/2005 Iguchi et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kuriyama et al.
7,034,752 B2 4/2006 Sekiguchi et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,061,430 B2 6/2006 Zheng et al.
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,129,893 B2 10/2006 Otaka et al.
7,136,019 B2 11/2006 Mikkola
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos
7,180,455 B2 2/2007 Oh et al.
7,193,574 B2 3/2007 Chiang et al.
7,205,942 B2 4/2007 Wang et al.
7,215,283 B2 5/2007 Boyle
7,218,280 B2 5/2007 Annamaa
7,218,282 B2 5/2007 Humpfer et al.
7,224,313 B2 5/2007 McKinzie, III et al.
7,230,574 B2 6/2007 Johnson
7,233,775 B2 6/2007 De Graauw
7,237,318 B2 7/2007 Annamaa
7,256,743 B2 8/2007 Korva
7,274,334 B2 9/2007 O'Riordan et al.
7,283,097 B2 10/2007 Wen et al.
7,289,064 B2 10/2007 Cheng
7,292,200 B2 11/2007 Posluszny et al.
7,319,432 B2 1/2008 Andersson
7,330,153 B2 2/2008 Rentz
7,333,067 B2 2/2008 Hung et al.
7,339,528 B2 3/2008 Wang et al.
7,340,286 B2 3/2008 Korva et al.
7,345,634 B2 3/2008 Ozkar et al.
7,352,326 B2 4/2008 Korva
7,355,270 B2 4/2008 Hasebe et al.
7,358,902 B2 4/2008 Erkocevic
7,375,695 B2 5/2008 Ishizuka et al.
7,381,774 B2 6/2008 Bish et al.
7,382,319 B2 6/2008 Kawahata et al.
7,385,556 B2 6/2008 Chung et al.
7,388,543 B2 6/2008 Vance
7,391,378 B2 6/2008 Mikkola
7,405,702 B2 7/2008 Annamaa et al.
7,417,588 B2 8/2008 Castany et al.
7,423,592 B2 9/2008 Pros et al.
7,432,860 B2 10/2008 Huynh
7,439,929 B2 10/2008 Ozkar
7,443,344 B2 10/2008 Boyle
7,468,700 B2 12/2008 Milosavlejevic
7,468,709 B2 12/2008 Niemi
7,498,990 B2 3/2009 Park et al.
7,501,983 B2 3/2009 Mikkola
7,502,598 B2 3/2009 Kronberger
7,564,413 B2 7/2009 Kim et al.
7,589,678 B2 9/2009 Perunka et al.
7,616,158 B2 11/2009 Mak et al.
7,633,449 B2 12/2009 Oh
7,663,551 B2 2/2010 Nissinen
7,679,565 B2 3/2010 Sorvala
7,692,543 B2 4/2010 Copeland
7,710,325 B2 5/2010 Cheng
7,724,204 B2 5/2010 Annamaa
7,760,146 B2 7/2010 Ollikainen
7,764,245 B2 7/2010 Loyet
7,786,938 B2 8/2010 Sorvala
7,800,544 B2 9/2010 Thornell-Pers
7,830,327 B2 11/2010 He
7,843,397 B2 11/2010 Boyle
7,889,139 B2 2/2011 Hobson et al.
7,889,143 B2 2/2011 Milosavljevic
7,901,617 B2 3/2011 Taylor
7,903,035 B2 3/2011 Mikkola et al.
7,916,086 B2 3/2011 Koskiniemi et al.
7,963,347 B2 6/2011 Pabon
7,973,720 B2 7/2011 Sorvala
8,049,670 B2 11/2011 Jung et al.
8,054,232 B2 11/2011 Chiang et al.
8,077,115 B2 * 12/2011 Yamada ..... H01Q 1/2225 343/795
8,098,202 B2 1/2012 Annamaa et al.
8,179,322 B2 5/2012 Nissinen
8,193,998 B2 6/2012 Puente et al.
8,378,892 B2 2/2013 Sorvala
8,466,756 B2 6/2013 Milosavljevic et al.
8,473,017 B2 6/2013 Milosavljevic et al.
8,564,485 B2 10/2013 Milosavljevic et al.
8,629,813 B2 1/2014 Milosavljevic
8,659,482 B2 * 2/2014 Kim et al. ..... 343/700 MS
2001/0050636 A1 12/2001 Weinberger
2002/0183013 A1 12/2002 Auckland et al.
2002/0196192 A1 12/2002 Nagumo et al.
2003/0085707 A1 * 5/2003 Minerbo ..... G01V 3/28 324/343
2003/0146873 A1 8/2003 Blancho
2003/0201945 A1 * 10/2003 Reece ..... H01Q 9/28 343/795
2004/0090378 A1 5/2004 Dai et al.
2004/0137950 A1 7/2004 Bolin et al.
2004/0140941 A1 * 7/2004 Joy ..... H01Q 9/16 343/795
2004/0145525 A1 7/2004 Annabi et al.
2004/0171403 A1 9/2004 Mikkola
2005/0057401 A1 3/2005 Yuanzhu
2005/0159131 A1 7/2005 Shibagaki et al.
2005/0176481 A1 8/2005 Jeong
2006/0071857 A1 4/2006 Pelzer
2006/0109192 A1 * 5/2006 Weigand ..... H01Q 1/22 343/795
2006/0119513 A1 * 6/2006 Lee ..... 342/374
2006/0192723 A1 8/2006 Harada
2006/0220962 A1 * 10/2006 d'Hont et al. ..... 343/700 MS
2007/0042615 A1 2/2007 Liao
2007/0082789 A1 4/2007 Nissila
2007/0152881 A1 7/2007 Chan
2007/0188388 A1 8/2007 Feng
2008/0055164 A1 3/2008 Zhang et al.
2008/0059106 A1 3/2008 Wight
2008/0088511 A1 4/2008 Sorvala
2008/0204328 A1 * 8/2008 Nissinen ..... 343/700 MS
2008/0246689 A1 10/2008 Qin et al.
2008/0266199 A1 10/2008 Milosavljevic
2009/0009400 A1 1/2009 Kim et al.
2009/0009415 A1 1/2009 Tanska

(56) References Cited

U.S. PATENT DOCUMENTS

| | | | | |
|---|---|---|---|---|
| 2009/0045961 | A1* | 2/2009 | Chamarti | G06K 19/07749 340/572.7 |
| 2009/0135066 | A1 | 5/2009 | Raappana et al. | |
| 2009/0153412 | A1 | 6/2009 | Chiang et al. | |
| 2009/0174604 | A1 | 7/2009 | Keskitalo | |
| 2009/0196160 | A1 | 8/2009 | Crombach | |
| 2009/0197654 | A1 | 8/2009 | Teshima | |
| 2009/0231213 | A1 | 9/2009 | Ishimiya | |
| 2009/0284432 | A1* | 11/2009 | Cozzolino | H01Q 1/36 343/821 |
| 2009/0322639 | A1* | 12/2009 | Lai | 343/770 |
| 2010/0156726 | A1* | 6/2010 | Montgomery et al. | 343/700 MS |
| 2010/0220016 | A1 | 9/2010 | Nissinen | |
| 2010/0244978 | A1 | 9/2010 | Milosavljevic | |
| 2010/0309092 | A1 | 12/2010 | Lambacka | |
| 2011/0068990 | A1* | 3/2011 | Grzyb et al. | 343/772 |
| 2011/0102268 | A1* | 5/2011 | Watanabe | H01Q 1/243 343/700 MS |
| 2011/0133994 | A1 | 6/2011 | Korva | |
| 2011/0207422 | A1* | 8/2011 | Ban | H01Q 1/48 455/128 |
| 2012/0119955 | A1 | 5/2012 | Milosavljevic et al. | |
| 2013/0088404 | A1* | 4/2013 | Ramachandran et al. | 343/853 |

FOREIGN PATENT DOCUMENTS

| | | |
|---|---|---|
| DE | 10104862 | 8/2002 |
| DE | 10150149 | 4/2003 |
| EP | 0 208 424 | 1/1987 |
| EP | 0 376 643 | 4/1990 |
| EP | 0 751 043 | 4/1997 |
| EP | 0 807 988 | 11/1997 |
| EP | 0 831 547 | 3/1998 |
| EP | 0 851 530 | 7/1998 |
| EP | 1 294 048 | 1/1999 |
| EP | 1 014 487 | 6/2000 |
| EP | 1 024 553 | 8/2000 |
| EP | 1 067 627 | 1/2001 |
| EP | 0 923 158 | 9/2002 |
| EP | 1 329 980 | 7/2003 |
| EP | 1 361 623 | 11/2003 |
| EP | 1 406 345 | 4/2004 |
| EP | 1 453 137 | 9/2004 |
| EP | 1 220 456 | 10/2004 |
| EP | 1 467 456 | 10/2004 |
| EP | 1 753 079 | 2/2007 |
| EP | 1881558 A2 | 1/2008 |
| FI | 20020829 | 11/2003 |
| FI | 118782 | 3/2008 |
| FR | 2553584 | 10/1983 |
| FR | 2724274 | 3/1996 |
| FR | 2873247 | 1/2006 |
| GB | 2266997 | 11/1993 |
| GB | 2360422 | 9/2001 |
| GB | 2389246 | 12/2003 |
| JP | 59-202831 | 11/1984 |
| JP | 60-206304 | 10/1985 |
| JP | 61-245704 | 11/1986 |
| JP | 06-152463 | 5/1994 |
| JP | 07-131234 | 5/1995 |
| JP | 07-221536 | 8/1995 |
| JP | 07-249923 | 9/1995 |
| JP | 07-307612 | 11/1995 |
| JP | 08-216571 | 8/1996 |
| JP | 09-083242 | 3/1997 |
| JP | 09-260934 | 10/1997 |
| JP | 09-307344 | 11/1997 |
| JP | 10-028013 | 1/1998 |
| JP | 10-107671 | 4/1998 |
| JP | 10-173423 | 6/1998 |
| JP | 10-209733 | 8/1998 |
| JP | 10-224142 | 8/1998 |
| JP | 10-322124 | 12/1998 |
| JP | 10-327011 | 12/1998 |
| JP | 11-004113 | 1/1999 |
| JP | 11-004117 | 1/1999 |
| JP | 11-068456 | 3/1999 |
| JP | 11-127010 | 5/1999 |
| JP | 11-127014 | 5/1999 |
| JP | 11-136025 | 5/1999 |
| JP | 11-355033 | 12/1999 |
| JP | 2000-278028 | 10/2000 |
| JP | 2001-053543 | 2/2001 |
| JP | 2001-267833 | 9/2001 |
| JP | 2001-217631 | 10/2001 |
| JP | 2001-326513 | 11/2001 |
| JP | 2002-319811 | 10/2002 |
| JP | 2002-329541 | 11/2002 |
| JP | 2002-335117 | 11/2002 |
| JP | 2003-060417 | 2/2003 |
| JP | 2003-124730 | 4/2003 |
| JP | 2003-179426 | 6/2003 |
| JP | 2004-112028 | 4/2004 |
| JP | 2004-363859 | 12/2004 |
| JP | 2005-005985 | 1/2005 |
| JP | 2005-252661 | 9/2005 |
| KR | 20010080521 | 10/2001 |
| KR | 20020096016 | 12/2002 |
| SE | 511900 | 12/1999 |
| WO | WO 92/00635 | 1/1992 |
| WO | WO 96/27219 | 9/1996 |
| WO | WO 98/01919 | 1/1998 |
| WO | WO 99/30479 | 6/1999 |
| WO | WO 01/20718 | 3/2001 |
| WO | WO 01/29927 | 4/2001 |
| WO | WO 01/33665 | 5/2001 |
| WO | WO 01/61781 | 8/2001 |
| WO | WO 2004/017462 | 2/2004 |
| WO | WO 2004/057697 | 7/2004 |
| WO | WO 2004/100313 | 11/2004 |
| WO | WO 2004/112189 | 12/2004 |
| WO | WO 2005/062416 | 7/2005 |
| WO | WO 2007/012697 | 2/2007 |
| WO | WO 2010/122220 | 10/2010 |

OTHER PUBLICATIONS

Dialio, A., et al. "Enhanced Diversity Antennas for UMTS Handsets", EuCAP 2006, Nice, France, Nov. 6-10, 2006 (ESA SP-626, Oct. 2006).

Plicanic, et al., "Actual Diversity Performance of a Multiband Diversity Antenna With Hand and Head Effects", IEEE Transactions on Antennas and Propagation, vol. 57, No. 5, May 2009.

Joshi, Ravi K., et al., "Broadband Concentric Rings Fractal Slot Antenna", XXVIIIth General Assembly of International Union of Radio Science (URSI). (Oct. 23-29, 2005), 4 Pgs.

Singh, Rajender, "Broadband Planar Monopole Antennas," M.Tech credit seminar report, Electronic Systems group, EE Dept, IIT Bombay, Nov. 2003, pp. 1-24.

Gobien, Andrew, T. "Investigation of Low Profile Antenna Designs for Use in Hand-Held Radios," Ch.3, *The Inverted-L Antenna and Variations*; Aug. 1997, pp. 42-76.

See, C.H., et al., "Design of Planar Metal-Plate Monopole Antenna for Third Generation Mobile Handsets," Telecommunications Research Centre, Bradford University, 2005, pp. 27-30.

Chen, Jin-Sen, et al., "CPW-fed Ring Slot Antenna with Small Ground Plane," Department of Electronic Engineering, Cheng Shiu University.

"LTE—an introduction," Ericsson White Paper, Jun. 2009, pp. 1-16.

"Spectrum Analysis for Future LTE Deployments," Motorola White Paper, 2007, pp. 1-8.

Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.

Wong, Kin-Lu, et al. "Planar Antennas for WLAN Applications," Dept. of Electrical Engineering, National Sun Yat-Sen University, 2002 09 Ansoft Workshop, pp. 1-45.

(56) References Cited

OTHER PUBLICATIONS

"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for EP Patent Application No. 12177740.3.
"An Adaptive Microstrip Patch Antenna for Use in Portable Transceivers", Rostbakken et al., Vehicular Technology Conference, 1996, Mobile Technology for the Human Race, pp. 339-343.
"Dual Band Antenna for Hand Held Portable Telephones", Liu et al., Electronics Letters, vol. 32, No. 7, 1996, pp. 609-610.
"Improved Bandwidth of Microstrip Antennas using Parasitic Elements," IEE Proc. vol. 127, Pt. H. No. 4, Aug. 1980.
"A 13.56MHz RFID Device and Software for Mobile Systems", by H. Ryoson, et al., Micro Systems Network Co., 2004 IEEE, pp. 241-244.
"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.
Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.
C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.
Cheng-Nan Hu, Willey Chen, and Book Tai, "A Compact Multi-Band Antenna Design for Mobile Handsets", *APMC 2005 Proceedings*.
Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.
European Office Action, May 30, 2005 issued during prosecution of EP 04 396 001.2-1248.
Examination Report dated May 3, 2006 issued by the EPO for European Patent Application No. 04 396 079.8.
F.R. Hsiao, et al. "A dual-band planar inverted-F patch antenna with a branch-line slit," *Microwave Opt. Technol. Lett.*, vol. 32, Feb. 20, 2002.
Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.
Guo, Y. X. and H. S. Tan, "New compact six-band internal antenna," *IEEE Antennas and Wireless Propagation Letters*, vol. 3, 295-297, 2004.
Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.
Hoon Park, et al. "Design of an Internal antenna with wide and multiband characteristics for a mobile handset", *IEEE Microw. & Opt. Tech. Lett.*vol. 48, No. 5, May 2006.
Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.
Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.
I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12. 2005.APMC 2005, Asia- Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wang, *Planar Antennas for Wireless Communications*, Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesidn.com), Copyright 2004, Freescale Semiconductor, RFD-24-EK.
S. Tarvas, et al. "An internal dual-band mobile phone antenna," in *2000 IEEE Antennas Propagat. Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.

* cited by examiner

MIMO ANTENNA AND METHODS

PRIORITY AND RELATED APPLICATIONS

This application is a National Stage Application of, and claims priority to, under 35 U.S.C. §371, International Application No. PCT/FI2010/050926, filed Nov. 16, 2010, which claims the benefit of priority to Finnish Patent Application Serial No. 20096251 filed 27 Nov. 2009, the priority benefit of which is also herein claimed, each of the foregoing being incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of Invention

The invention relates generally to an antenna of a radio device, such as small-sized mobile wireless stations, and particularly in one exemplary aspect to spatial multiplexing.

2. Description of Related Technology

The spatial multiplexing means a technique, by which the digital signal to be transmitted to a radio path is divided to at least two signals with lower rate, which signals are provided with a signature. The signals are then transmitted in the same frequency channel, each by means of an antenna of its own. The receiver, which also has more than one antenna, constructs different transmitting signals on grounds of the signatures and then combines them into the original signal. In this way the transfer capacity of the frequency channel can be increased. Optionally, the principle can be used for improving the transfer reliability by transmitting the one and the same signal with the antennas (space diversity). Spatial multiplexing will be used, for example, in the systems congruent to the LTE standard (Long Term Evolution), produced in the 3GPP (3rd Generation Partnership Project).

An antenna structure required in spatial multiplexing is called a MIMO antenna (Multiple-In Multiple-Out). The MIMO antenna to be described here comprises multiple (e.g., two) partial antennas inside the covers of a small-sized radio device. This kind of antenna structures are not new as such. For example, FIG. 1 shows a MIMO antenna known from the article "*Actual Diversity Performance of a Multiband Diversity Antenna With Hand and Head Effects*" (IEEE TRANSACTIONS ON ANTENNAS AND PROPAGATION, VOL. 57, NO. 5, May 2009, pp. 1547-1555). It comprises a first 110 and a second 120 antenna component and the ground plane GND. Each antenna component comprises an elongated substrate and a radiator, which is of conductive coating of the substrate. The antenna components are located at the opposite ends of the rectangular circuit board PCB of a radio device so that their longitudinal direction is the same as the direction of the shorter sides of the circuit board.

The first antenna component 110 constitutes together with the ground plane GND the first partial antenna of monopole type, which includes the first radiator 112. The feed point of the first partial antenna, or the first feed point FP1, is located at an end of the antenna component 110 on the circuit board PCB close to its one long side. The first radiator 112 rises from the first feed point via the inner side surface of the first substrate 111 to the upper surface of the substrate, where it branches to a part on the upper surface and a part on the outer side surface of the substrate. The former part is for implementing the higher operating band of the antenna, and the latter, which includes a relatively dense meander portion to lower the resonance frequency, is for implementing the lower operating band of the antenna. Also a parasitic radiator is on the surface of the first substrate for shaping the higher operating band. The ground plane GND extends on the circuit board close to the first antenna component 110 so that its edge is beside the antenna component and has the same direction as the component.

The second antenna component 120 constitutes together with the ground plane GND the second partial antenna, which includes the second radiator 122. The feed point of the second partial antenna, or the second feed point FP2, is located at an end of the antenna component 120 on the circuit board PCB close to its same long side as also the first feed point. The second radiator 122 rises from the second feed point via the outer side surface of the second substrate 121 to the upper surface of the substrate, where it branches to two parts. One of these is plate-like and is for implementing the lower operating band of the antenna, and the other is for implementing the higher operating band. The second radiator is connected to the ground plane GND at the short-circuit point SP next to the second feed point FP2. The ground plane GND extends on the circuit board under the second radiator, the second partial thus antenna being of PIFA type (Planar Inverted-F Antenna). Also the second partial antenna includes a parasitic radiator for shaping the higher operating band.

A MIMO antenna naturally functions the better the less the partial antennas influence each other, or the lower the correlation between them is. The correlation again is in principle the higher the closer the partial antennas are to each other. This means a problem in small radio devices, because in them the antennas are inevitably relatively close to each other. In the multiband antennas the problem concerns particularly the lowest operating band, because at its frequencies the distance between the partial antennas in proportion to the wavelength is the shortest.

Figure 3:
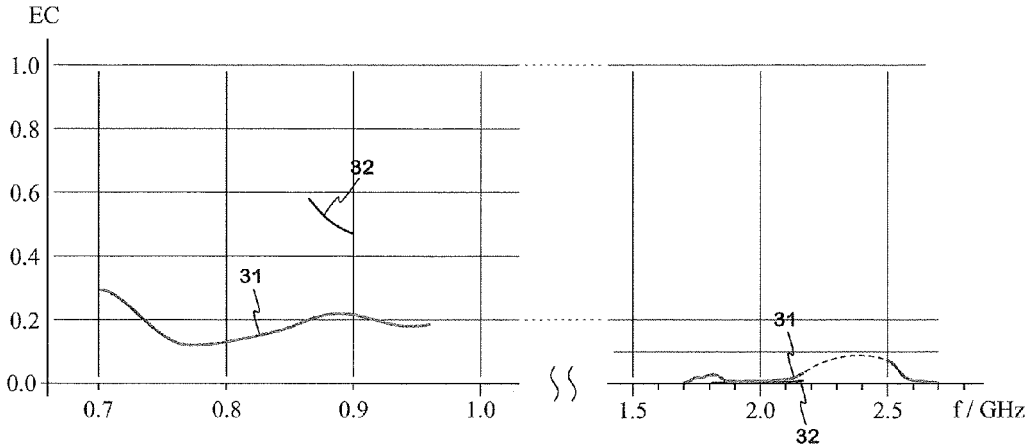

For the above-mentioned reasons also in the antenna according to FIG. 1 the correlation between the partial antennas in the lower operating band and in free space is remarkably high (FIG. 3, curve 32). The second partial antenna of the structure has been designed especially for improving diversity. Because of the effect of the user's hand the efficiency of the antenna naturally lowers. However, also the correlation lowers in the structure in FIG. 1, which matter improves the diversity gain and thus to some degree compensates for the degradation of the efficiency. Nevertheless, the level of correlation between the partial antennas is not optimal.

An object of the invention is to implement a MIMO antenna in a new and advantageous way.

In one aspect of the invention, an antenna comprises two antenna components with a substrate and a radiator, the components being located on the opposite sides of the circuit board of a radio device. In one embodiment, each antenna component constitutes, with the ground plane of the radio device, a partial antenna, the operating band of which is below the frequency of 1 GHz. The ground plane and the feed points of the partial antennas are arranged so that the 'dipole axes' of the partial antennas have clearly different directions at the frequencies of said operating band. Namely, at these frequencies the partial antennas are dipole-like, the ground plane representing the other arm of the 'dipole'.

One salient advantage of the invention relates to the capability of a MIMO antenna for a small-sized radio device at frequencies below 1 GHz which is higher than that of corresponding known antennas. This is due to the fact that the correlation between the signals of the partial antennas is quite low because of the difference between the directions of their 'dipole axes'.

In another aspect of the invention, an antenna for use in a radio device is disclosed. In one embodiment, the antenna includes: a first antenna element comprising a first feed point, a first substrate portion and a first radiator; a second antenna element comprising a second feed point, a second substrate portion and a second radiator; and a ground plane disposed substantially between the first and second antennas. In one variant, the first and second antenna elements are located on opposing sides of an antenna substrate of the radio device, with the first and second feed points of the first and second antennas being located proximate on a same edge of the antenna substrate.

In another embodiment, the antenna includes: a substantially planar substrate; a first antenna component disposed in a first region of the substrate; and a second antenna component disposed in a second region of the substrate. The first and second antenna components are further disposed such that a dipole axis of the first antenna component is substantially different in orientation from a dipole axis of the second antenna component.

In another embodiment, the antenna includes a first antenna component with a first substrate and a first radiator; a second antenna component with a second substrate and a second radiator; and a ground plane between the first and second antenna components. The first antenna component constitutes with the ground plane a first partial antenna which has a first feed point, and the second antenna component constitutes with the ground plane a second partial antenna which has a second feed point, and both the first and second partial antennas have an operating band below the frequency of 1 GHz, with the first and second antenna components located on different sides of a circuit board of the radio device in order to lower the correlation between the signals of the partial antennas. The feed points are located on the same side of the circuit board, the first feed point at an end of the first antenna component and the second feed point at an end of the second antenna component so as to further lower the correlation between the signals of the partial antennas in the operating band.

In yet another embodiment, the antenna is a multiple input multiple output (MIMO) antenna, and includes: a substantially planar substrate; a first antenna component disposed in a first region of the substrate; and a second antenna component disposed in a second region of the substrate. The first and second antenna components are further disposed relative the substrate and each other such that a radio frequency correlation of the first antenna component with the second antenna component in at least a first frequency band is minimized.

In another aspect of the invention, a compact form-factor radio device is disclosed. In one embodiment, the device is a smartphone or tablet computer, and includes: at least one wireless transceiver; a multiple input multiple output (MIMO) antenna in signal communication with the at least one transceiver, the antenna including: a substantially planar substrate; a first antenna component disposed in a first region of the substrate; and a second antenna component disposed in a second region of the substrate. The first and second antenna components are further disposed such that a dipole axis of the first antenna component when operating at a frequency below 1 GHz is substantially different in orientation from a dipole axis of the second antenna component when operating at a frequency below 1 GHz. The device further includes a compact form factor housing substantially enclosing the at least one transceiver and the antenna.

Figure 2:
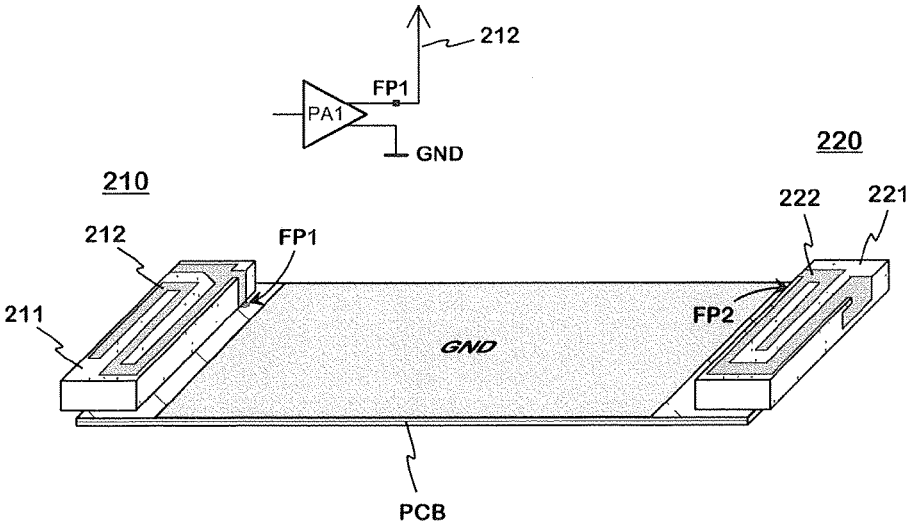
Figure 4:
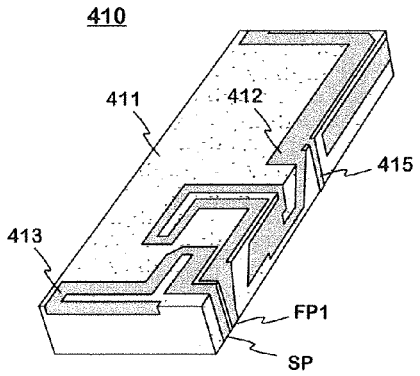
Figure 5A:
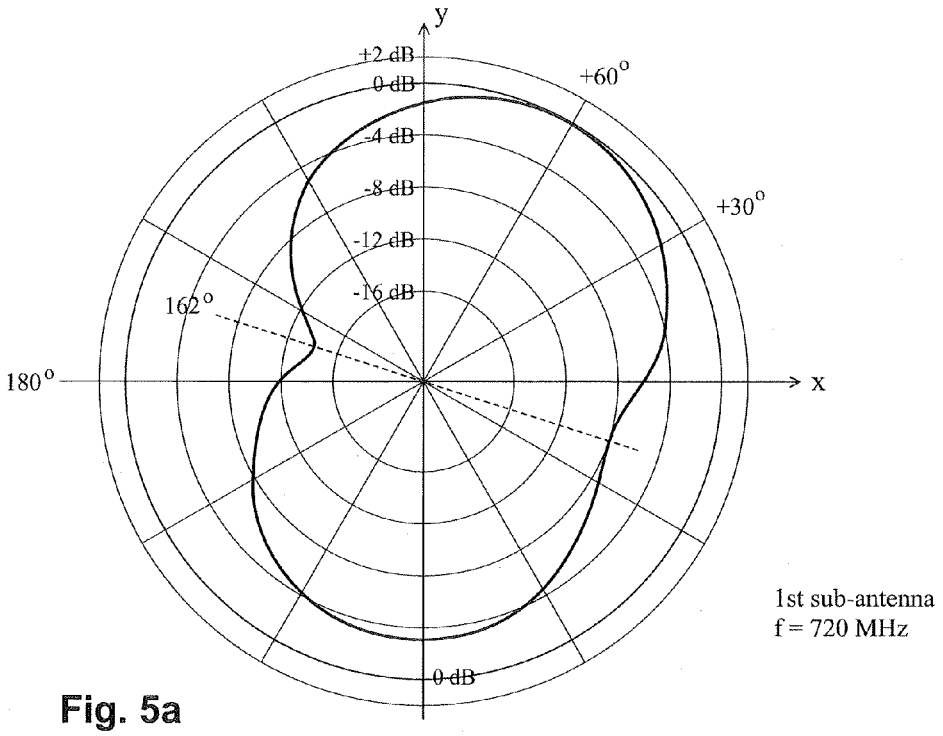
Figure 6:
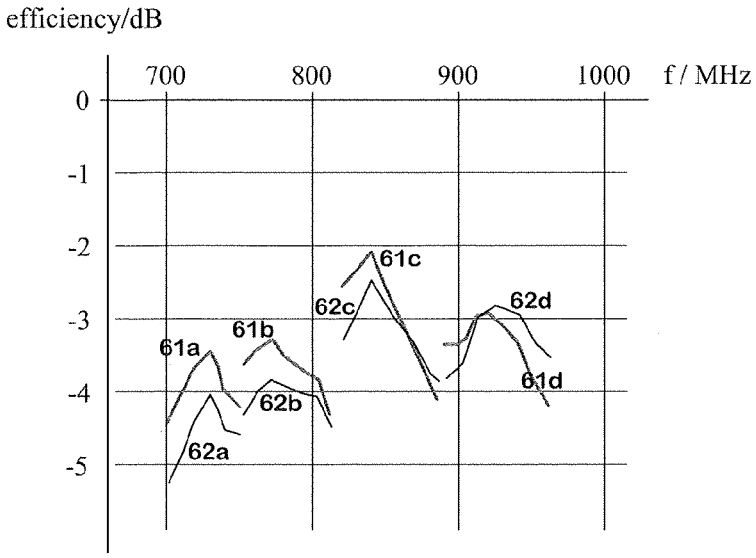
Figure 7:
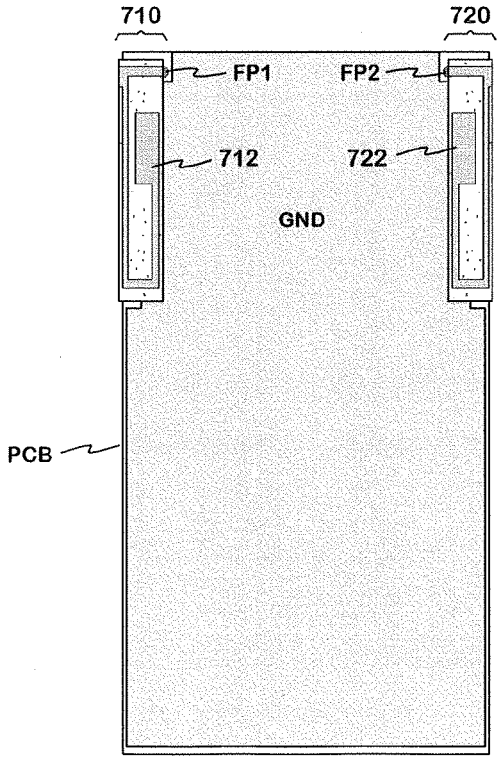

These and other features, objectives, and advantages of the invention will become more apparent from the detailed description set forth below when taken in conjunction with the drawings, wherein:

FIG. 1 presents an example of the MIMO antenna according to prior art,

FIG. 2 presents an example of the MIMO antenna according to the invention,

FIG. 3 presents an example of the correlation between the signals of the partial antennas in the antenna according to the invention, FIG. 4 presents an example of the antenna component to be used in an antenna according to the invention, FIGS. 5*a,b* present an example of the radiation pattern of an antenna according to the invention, FIG. 6 presents an example of the efficiency of the antenna according to the invention and FIG. 7 presents another example of the MIMO antenna according to the invention.

FIG. 1 was already described in connection with the description of prior art.

FIG. 2 shows an example of the MIMO antenna according to the invention. It comprises a ground plane GND and two elongated antenna components 210, 220. These are located at the opposite ends of the rectangular circuit board PCB of a radio device so that their longitudinal direction is the same as the transverse direction of the circuit board, or the direction of its shorter sides. The ground plane GND is on the circuit board between the antenna components so that it extends relatively close to the antenna components. The edge of the ground plane is then in this example at a distance from both antenna components.

The first antenna component 210 comprises the first substrate 211 and the first radiator 212, which is of conductive coating of the first substrate. The first antenna component 210 constitutes together with the ground plane the first partial antenna. The feed point of the first partial antenna, or the first feed point FP1, is located at an end of the antenna component 210 on the circuit board PCB on its one longer side, in other words, compared to the width of the circuit board, relatively close to the edge of the circuit board which corresponds to said longer side. The first radiator 212 rises from the first feed point via the inner side surface of the first substrate to the upper surface of the substrate, where it forms a certain pattern. The radiator may extend also to the outer side surface and head surfaces of the substrate.

The second antenna component 220 comprises the second substrate 221 and the second radiator 222, which is of conductive coating of the second substrate. The second antenna component constitutes together with the ground plane the second partial antenna. The feed point of the second partial antenna, or the second feed point FP2, is located at an end of the antenna component 220 on the circuit board PCB on its same longer side as also the first feed point. The second radiator rises from the second feed point via the inner side surface of the second substrate to the upper surface of the substrate, where it forms a certain pattern, extending also to the outer side surface of the substrate. The first and second radiator is designed to resonate in the same band below the frequency of 1 GHz. By shape, the radiators may be mirror images of each other in respect of the middle line between the antenna components. On the other hand, if the location of the feed points is not quite optimal, the correlation between the signals of the partial antennas can be improved, or lowered, by making their radiators to have a suitably different shape. In the example of FIG. 2, the second as well as the first radiator comprises also an arm for implementing the higher operating band of the antenna.

Above, the 'end' of an antenna component (and substrate) means its part, which is bounded by the head surface and is relatively short compared with the length of the component. The 'inner' side surface of a substrate means its side surface, which is on the side of the middle part of the circuit board PCB.

The first partial antenna and the power amplifier PA1 feeding it are shown also as a simple circuit diagram in FIG. 2. A similar diagram can naturally be drawn also for the second partial antenna.

It is substantial in various embodiments of the invention that the 'dipole axes' of the partial antennas are arranged to have clearly different directions at the frequencies of the lower operating band of the antenna, or the band below 1 GHz. In this case quite a low correlation between the signals of the partial antennas is achieved, although the distance between the partial antennas is short compared with the wavelength. The direction of a dipole axis means here the direction, where the strength of the electric field in the radiation of the dipole as if formed by the antenna radiator and ground plane is at its minimum. On the circuit board in FIG. 2 the 'dipole axis' of a partial antenna travels from its feed point diagonally across the ground plane. The location of the feed points of the partial antennas on the same side of the circuit board and the shape of the ground plane are factors which result in the different directions of the 'dipole axes'. If the ground plane is very narrow, the 'dipole axes' position themselves too much in the same direction. Also the shape of the radiator proper has significance for the radiation pattern of the partial antenna and thus for said correlation. Namely, the route and intensity of the currents in the ground plane, which matters affect the radiation pattern formed, depend partly on the radiator.

In FIG. 3 there is an example of the correlation between the signals of the partial antennas in the MIMO antenna according to the invention. Curve 31 shows such a correlation, to be precise the envelope cross correlation, or envelope correlation EC, when the antenna is in free space. In the optimum case this correlation is zero, and the worst possible value is one. It appears from the curve that in the range of the antenna's lower operating band 700-960 MHz the correlation varies between the values 0.12 and 0.3 being less than 0.2 on average.

For comparison there is the curve 32 in FIG. 3, which shows the correlation in free space between the signals of the partial antennas in the antenna according to FIG. 1. The measurement has concerned in the lower operating band only the downlink range 869-894 MHz of the GSM850 system, in which range the correlation EC is about 0.5 on average. In the structure according to the invention it is about 0.2 in said range which is clearly better.

In the ranges of the higher operating band the envelope correlation is very low in both antennas.

FIG. 4 shows an example of the antenna component to be used in an antenna according to the invention. The antenna component 410 comprises a substrate 411 and as its conductive coating a first radiator 412 and a parasitic radiator 413. The first radiator rises from the feed point FP1 located at one end of the antenna component via a side surface of the substrate to the upper surface, makes a pattern there, returns back to the side surface then again to the upper surface and via the other head surface to the same side surface, from which it has started. Thus the first radiator constitutes a monopole antenna with the ground plane. The lower operating band of an antenna made by the component 410 is based on the resonance of the conductor of the first radiator 412. In addition, the first radiator is involved in the implementation of the higher operating band so that two radiating slots remain between its portions, which slots resonate in the higher operating band. The parasitic radiator 413 is for widening the higher operating band. It is connected to the ground plane from the short-circuit point SP located next to the feed point FP1.

An intermediate conductor 415 branches from the first radiator 412 about halfway along it, which conductor is intended to be connected to the adjusting circuit of the antenna. By means of the adjusting circuit the lower operating band of the antenna can be shifted so that it covers the frequency band currently needed.

Figure 5B:
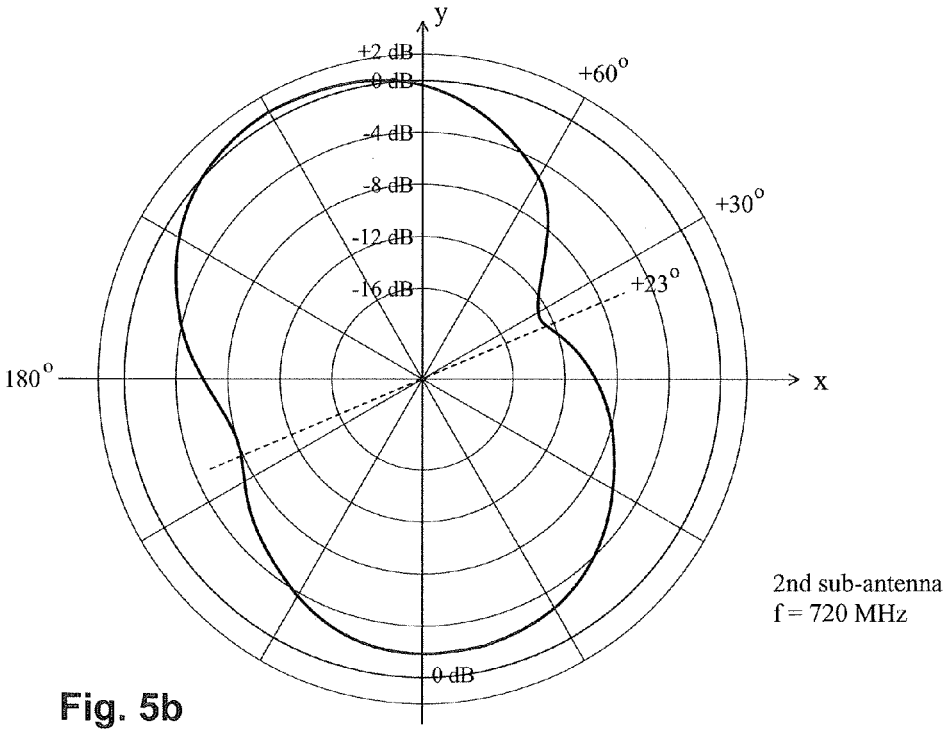

FIGS. 5*a* and 5*b* show an example of the radiation patterns of an antenna according to the invention. The patterns concern the same antenna as the correlation curve 31 in FIG. 3. In FIG. 5*a* there is the radiation pattern of the first partial antenna and in FIG. 5*b* of the second partial antenna according to the strength of the electric field. Both of them show the radiation pattern in the plane of the circuit board, or in the xy-plane. The direction x is the longitudinal direction of the circuit board towards the second partial antenna, and the direction y is the transverse direction of the circuit board from the side of the feed points towards the opposite side. The origo is in the centre of the circuit board. Both patterns are valid in free space and at the frequency of 720 MHz When measuring one partial antenna, the other partial antenna has been connected to the 50Ω matching resistance.

Both radiation patterns have one relatively deep minimum, −13 . . . −14 dB, and another minimum in the opposite direction. The angle between the 'dipole axes' drawn through the minimums is 162°-23°, or about 140° (or its complement 40°). Thus, the directions deviate clearly from each other, which is a benefit when minimizing the correlation.

FIG. 6 shows an example of the efficiency of an antenna according to the invention. The adjustable antenna mentioned in the description of FIG. 4 is in question, in which antenna the lower operating band can be set to four different place inside the whole range of 700-960 MHz. Curves 61*a*, 61*b*, 61*c* and 61*d* show the fluctuation of the efficiency of the first partial antenna in these four alternative ranges of the lower operating band. Correspondingly curves 62*a*, 62*b*, 62*c* and 62*d* show the fluctuation of the efficiency of the second partial antenna in said alternative ranges. The efficiency is the best, when the range 820-880 MHz has been chosen and the worst, when the range 700-760 MHz has been chosen. The total fluctuation in the efficiency of the first partial antenna is about −4.3 to −2.1 dB, and the total fluctuation in the efficiency of the second partial antenna is about −5.3 to −2.5 dB. The values are valid in free space.

FIG. 7 shows another example of the MIMO antenna according to the invention. It comprises a ground plane GND and two elongated antenna components 710, 720. In this case these are located at the same end of the circuit board PCB of a radio device, on the opposite longer sides of the circuit board. Thus the longitudinal direction of the antenna components is the same as the longitudinal direction of the circuit board. The ground plane is on the circuit board between the antenna components extending in this example under the antenna components.

The first antenna component 710 comprises a substrate and the first radiator 712, which is of its conductive coating. The first antenna component constitutes together with the ground plane GND the first partial antenna. Its feed point, or the first feed point FP1, is located at an end of the antenna component 710 on the circuit board PCB, on the side of the inner side surface of the antenna component. Correspondingly the second antenna component 720 comprises a substrate and the second radiator 722, which is of its conductive coating. The second antenna component constitutes together with the ground plane the second partial antenna.

Its feed point, or the second feed point FP2, is located at an end of the antenna component 720 on the circuit board PCB, on the side of the inner side surface of the antenna component. In FIG. 7 both feed points are located on one shorter side of the circuit board, in other words, relatively close to the edge of the circuit board which corresponds to said shorter side.

The radiators are here mirror images of each other so that the first radiator 712 is by shape a mirror image of the second radiator 722 in respect of the plane, which has the direction of the longitudinal direction of the second antenna component 720 and is perpendicular to the circuit board. This feature is preferable especially in this case, when the antenna components are located considerably closer to each other than in the example of FIG. 2.

A MIMO antenna according to the invention has been described above. In details, its structure can naturally differ from what is presented. The shapes of the radiating elements can vary greatly. A radiator can also be connected to the ground so that, instead of a monopole antenna, an IFA (Inverted-F Antenna) or a loop antenna is formed. The antenna components do not have to be exactly parallel and located precisely at the edge of the circuit board. The circuit board does not have to be precisely rectangular. The invention does not limit the way of manufacturing of the antenna. The inventive idea can be applied in different ways within the scope set by the independent claim 1.

The invention claimed is:

1. An antenna, comprising:

a substantially planar substrate;

a first antenna component disposed in a first region of the substantially planar substrate; and a second antenna component disposed in a second region of the substantially planar substrate;

wherein the first and second antenna components are further disposed such that a dipole axis of the first antenna component is substantially different in orientation from a dipole axis of the second antenna component; and wherein the first and second antenna components comprise first and second radiator elements, respectively, and the first and second radiator elements are substantially mirror images of one another with respect to a plane that is resident between the first and second antenna components, the plane being orthogonal to the substantially planar substrate.

2. The antenna of claim 1, wherein the substrate is substantially rectangular in shape and comprises first and second ends, and the first region is disposed at or near the first end of the substrate, and the second region is disposed at or near the second end of the substrate.

3. The antenna of claim 1, wherein the first and second antenna components comprise a first and a second partial radiator element, respectively, each of the first and second partial radiator elements is configured to radiate in at least a common frequency band.

4. The antenna of claim 3, wherein first and second feed points associated with the first and second antenna components, respectively, are both disposed proximate a common edge of the substrate, and interior to the first and second antenna components, respectively.

5. The antenna of claim 1, wherein first and second feed points associated with the first and second antenna components, respectively, are both disposed proximate a common edge of the substrate, and interior to the first and second antenna components, respectively.

6. A compact form-factor radio device, comprising:

at least one wireless transceiver;

a multiple input multiple output (MIMO) antenna in signal communication with the at least one transceiver, the antenna comprising:

a substantially planar substrate;

a first antenna component disposed in a first region of the substantially planar substrate, the first antenna component comprising a first radiator; and a second antenna component disposed in a second region of the substantially planar substrate, the second antenna component comprising a second radiator;

wherein the first and second antenna components are further disposed such that a dipole axis of the first antenna component when operating at a frequency below 1 GHz is substantially different in orientation from a dipole axis of the second antenna component when operating at a frequency below 1 GHz; and a compact form factor housing substantially enclosing the at least one transceiver and the antenna;

wherein the first radiator comprises a substantially mirror image shape of the second radiator at least with respect to a plane that is orthogonal with the substantially planar substrate; and wherein each of the first and second radiators is structured to run along a first surface of the respective antenna component, then onto another surface that is substantially perpendicular to the first surface, and then return onto the first surface.

7. A multiple input multiple output (MIMO) antenna, comprising:

a substantially planar substrate;

a first antenna component disposed in a first region of the substantially planar substrate, the first antenna component comprising a first radiator; and a second antenna component disposed in a second region of the substantially planar substrate, the second antenna component comprising a second radiator;

wherein the first and second antenna components are further disposed relative the substantially planar substrate and each other such that a radio frequency correlation of the first antenna component with the second antenna component in at least a first frequency band is minimized;

wherein each of the first and second radiators is structured to run along a first surface of the respective antenna component, then onto another surface that is substantially orthogonal with the first surface, and then return onto the first surface.

8. The antenna of claim 7, wherein the correlation comprises at least one of: (i) a cross-correlation; and/or (ii) an envelope correlation, measured in free space.

9. The antenna of claim 8, wherein the first frequency band comprises a band below 1 GHz.

10. An antenna of a radio device, comprising:

a first antenna component with a first substrate and a first radiator;

a second antenna component with a second substrate and a second radiator; and a ground plane between the first and second antenna components;

wherein the first antenna component constitutes with the ground plane a first partial antenna which has a first feed point, and the second antenna component constitutes with the ground plane a second partial antenna which has a second feed point;

wherein both the first and second partial antennas have an operating band below the frequency of 1 GHz, with the first and second antenna components located on different sides of a circuit board of the radio device in order to lower the correlation between the signals of the partial antennas;

wherein the first and second feed points are located on the same side of the circuit board, the first feed point at an end of the first antenna component and the second feed point at an end of the second antenna component so as to further lower the correlation between the signals of the partial antennas in the operating band, the first and second feed points being disposed interior of the first and second antenna components, respectively; and wherein at least one of the first and second radiators traverses from its respective feed point via a side surface of the respective substrate to an upper surface thereof, and then subsequently returns to the side surface.

11. The antenna of claim 10, in which the circuit board is elongated so that it has a longitudinal and transverse direction, wherein the longitudinal direction of the antenna components is substantially the same as the transverse direction of the circuit board, and the same side of the circuit board on which the feed points of the partial antennas are located comprises a longitudinal side of the circuit board.

12. The antenna of claim 10, in which the circuit board is elongated so that it has a longitudinal and transverse direction, wherein the longitudinal direction of the antenna components is substantially the same as the longitudinal direction of the circuit board, and the same side of the circuit board on which the feed points of the partial antennas are located, is a transverse side of the circuit board.

13. The antenna of claim 10, wherein the first radiator comprises a mirror image shape of the second radiator in respect of a plane which has a direction of the longitudinal direction of the second antenna component and is perpendicular to the circuit board.

14. The antenna of claim 10, wherein the partial antennas are monopole antennas.

15. The antenna of claim 14, wherein each partial antenna further comprises an adjusting circuit connected to the respective radiator to set the operating band in a range currently needed.

16. The antenna of claim 14, wherein each of the radiators is shaped to resonate in a frequency range on the order of 2 GHz to implement a higher operating band for the antenna.

17. The antenna of claim 14, wherein each of the partial antennas further comprises a parasitic radiator to widen a higher operating band.

* * * * *